United States Patent [19]

Halbeisen et al.

[11] Patent Number: 4,867,059

[45] Date of Patent: Sep. 19, 1989

[54] IMPACT PRINTER PRINT MECHANISM AND METHOD OF MANUFACTURE

[75] Inventors: Richard A. Halbeisen; Stephen S. Harding; Robert A. Sebrosky, all of Charlotte, N.C.

[73] Assignee: International Business Machines Corporation, Armonk, N.Y.

[21] Appl. No.: 229,033

[22] Filed: Aug. 5, 1988

[51] Int. Cl.[4] ..... B41J 9/10; B41J 9/38

[52] U.S. Cl. ..... 101/93.29; 101/93.34; 400/157.2

[58] Field of Search ..... 101/93.02, 93.29, 93.32, 101/93.33, 93.34, 93.48; 400/53, 157.2, 167; 335/255, 256, 257, 258; 29/592 R, 602 R

[56] References Cited

U.S. PATENT DOCUMENTS

| | | | |
|---|---|---|---|
| 3,726,213 | 4/1973 | Herbert | 101/93.02 |
| 4,371,857 | 2/1983 | Bohg et al. | 335/259 |
| 4,388,861 | 6/1983 | Bohg et al. | 101/93.02 |
| 4,412,197 | 10/1983 | Bohg et al. | 335/256 |
| 4,425,845 | 1/1984 | Bohg et al. | 101/93.34 |
| 4,496,253 | 1/1985 | Morsing | 400/157.2 |
| 4,527,139 | 7/1985 | Bohg et al. | 335/256 |

OTHER PUBLICATIONS

"Horizontal Sliding Print Hammer Mechanism," IBM Technical Disclosure Bulletin, vol. 25, No. 11B (Apr. 1983).

*Primary Examiner*—David A. Wiecking

*Attorney, Agent, or Firm*—Bell, Seltzer, Park & Gibson

[57] ABSTRACT

Electromagnets and spring-damper units respectively impart forward movement and rearward movement to slider members having hammer faces at their forward ends and armatures intermediate their lengths. The electromagnets and spring-damper units are mounted by the frame of the print mechanism for independent longitudinal adjustive movement. Adjustive movement of the spring-damper assemblies effects lateral alignment of the hammer faces at the forward ends of the sliders. Adjustive movement of the electromagnets effects adjustment of the forward movement characteristics of the sliders. Clamping forces are preferably imposed upon the electromagnets pending and during their adjustive movement. Anchoring of the electromagnets in their final positions preferably is accomplished by laser welding. An inexpensive frame plate restrains lateral movement of the sliders, maintains desired spacing between the pole faces of confronting electromagnets, and provides a surface upon which adjustive movement of the electromagnets can readily occur.

16 Claims, 3 Drawing Sheets

IMPACT PRINTER PRINT MECHANISM AND METHOD OF MANUFACTURE

FIELD OF THE INVENTION

This invention relates to print mechanisms, of the linear actuater type, that have laterally spaced and longitudinally movable ram or slider members which are selectively driven forwardly by electromagnets and are returned rearwardly by spring-damper units.

BACKGROUND OF THE INVENTION

Each slider member of a printing mechanism of the foregoing type customarily has a hammer face at its forward end, a bumper surface at its rearward end, and armature elements intermediate its length. The hammer face engages a print band of the like during each electromagnetically-induced stroke of forward movement of the slider, and the bumper surface engages a damper pad of the associated spring-damper unit upon spring-induced return movement of the slider in a rearward direction to an inactive position. For optimum performance the hammer faces of the sliders should be in substantial lateral alignment when the sliders occupy their inactive positions, and each forward stroke of slider movement should be of minimum duration or "flight time" and should generate an impact force of maximum magnitude between the hammer face of the slider and the print band. The flight time and impact force attendant each forward stroke of slider movement are affected by and dependent in significant part upon the relative longitudinal positional relationship present between the pole faces of the electromagnets and the armature elements of the slider when the slider occupies its inactive position. The inactive position occupied by the slider is determined by the location of the damper pad of the spring-damper unit associated with the slider, and may be varied in a longitudinal direction by adjustment of the unit when it is capable of adjustive movement in such direction.

Positional adjustment of the spring-damper units may be employed either to laterally align the hammer faces of the sliders or to optimize their strokes of forward movement, but not for both purposes. Adjustment of the units for the former purpose does not also result in optimization of the forward strokes of slider movement, and adjustment of the units for the later purpose leaves the hammer faces of the sliders laterally nonaligned. One previously proposed way of correcting misalignment of the hammer faces has been by subjecting them to a grinding operation after positional adjustment of the spring-damper units has been completed. This method of effecting lateral alignment between the hammer faces is time-consuming and costly, and additionally risks introduction into the print mechanism of metallic particles detrimental to its operation. The foregoing procedure is highly unsatisfactory, and there is a need for a print mechanism of the linear actuator type in which the desired lateral alignment of the slider hammer faces and optimization of the forward strokes of movement the sliders can be efficiently, economically and clearly achieved.

BACKGROUND PRIOR ART

Print mechanisms of the linear actuator type that have slider or ram members which are driven forwardly by associated electromagnets, and which are returned rearwardly by spring-containing units, are disclosed in the IBM Technical Disclosure Bulletin entitled HORIZONTAL SLIDING PRINT MECHANISM (Vol. 25, No. 11B, April 1983), and in the following U.S. Pat. Nos.: 4,371,857, 4,388,861, 4,412,197, 4,425,845 and 4,527,139. U.S. Pat. No. 4,388,861 also refers in its "Background Art" section to a printer, of the "clapper" type instead of the linear actuator type, in which adjustment of flight time is realized by adjustment of electromagnets associated with the print hammer units.

SUMMARY OF THE INVENTION

The present invention provides an improved linearaction printing mechanism and manufacturing method that permit economical mass production of the mechanisms, optimization of the flight times and impact forces attendant forward movement of their slider components, and efficient lateral alignment of the hammer faces of the sliders. The print mechanism of the invention has spring-damper units and electromagnet actuators that are independently adjustable in the longitudinal direction, i.e., direction parallel to the longitudinal axes of the sliders with which they are associated. During assembly of the mechanism each spring-damper unit is longitudinally adjusted as required to bring the forward ends of the sliders into substantial lateral alignment with each other. The longitudinal positions of the electromagnets are then adjusted as necessary to optimize the flight time and impact force attendant forward movement of the sliders. Since post-assembly grinding or similar machining of the sliders is not required, the mechanisms can be economically produced.

Also contributing to the foregoing economy of manufacture of the mechanism is its inclusion, in a preferred embodiment of the invention, of an inexpensive stamped frame plate, in lieu of more expensive machined or similarly formed components, for separating the sliders from each other and constraining their lateral movement. Such plate may and preferably does also establish and maintain desired spacings between pole faces of confronting ones of the electromagnets, and provides smooth surfaces upon which adjustive sliding movement of the electromagnets can readily occur.

DESCRIPTION OF THE DRAWINGS

Other features of the invention will be apparent from the following description of an illustrative embodiment thereof, which should be read in conjunction with the accompanying drawings, in which.

DESCRIPTION OF THE PREFERRED EMBODIMENT

Figure 1:
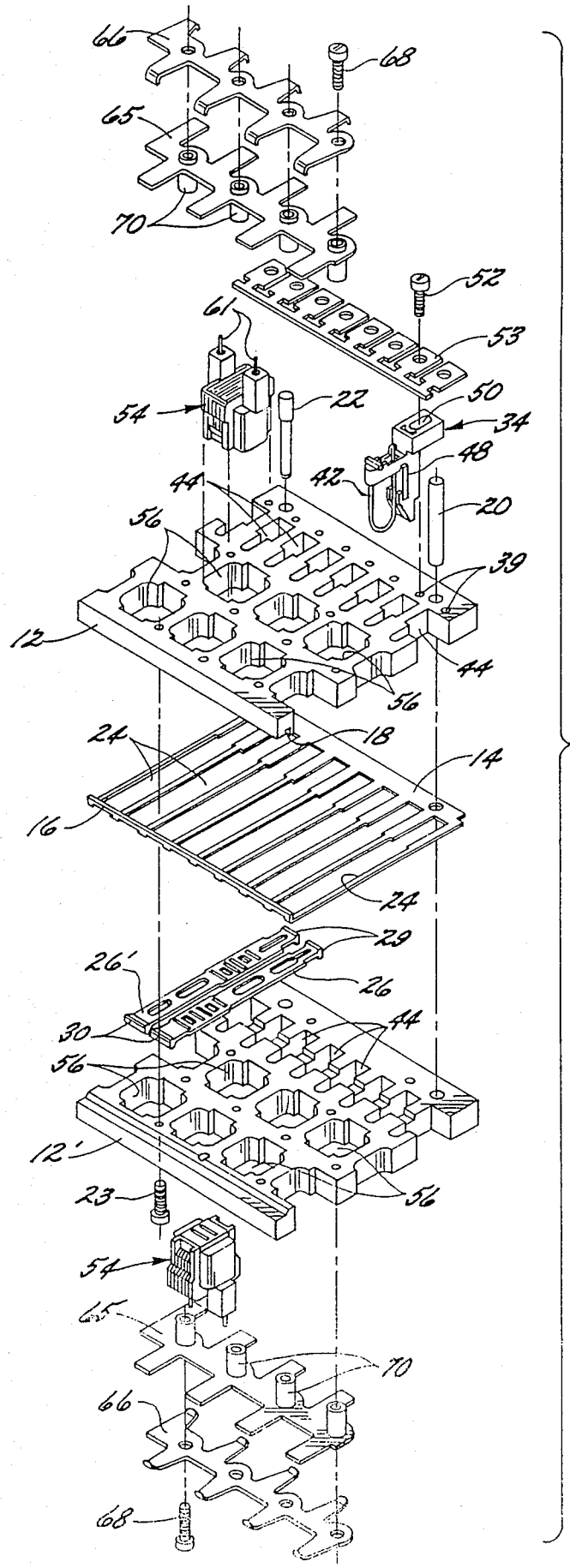
FIG. 1 is an exploded front perspective view of components of a module of a print mechanism in accordance with the invention.
Figure 2:
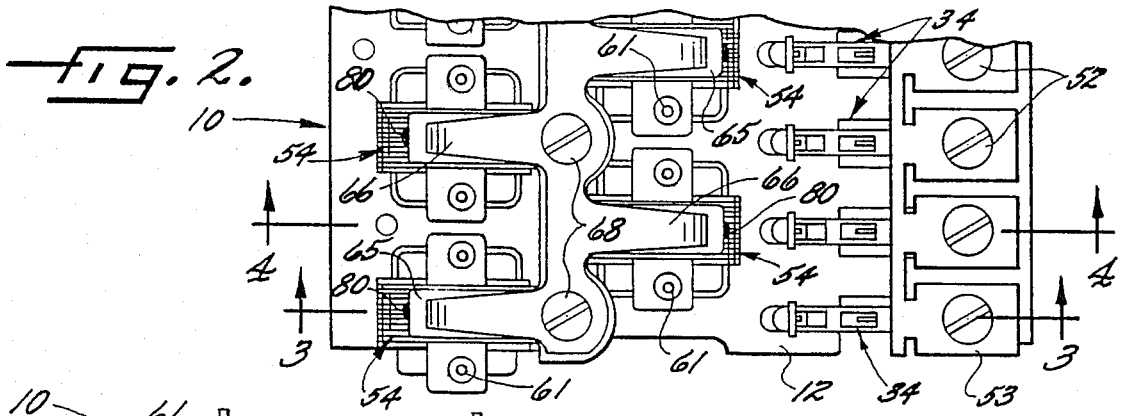
FIG. 2 is an enlarged fragmentary top plan view of the assembled print mechanism module.

In the accompanying drawings the numeral 10 designates one of a plurality of modules, the remainder of which are not shown, of a high-speed impact printer of the linear actuator type. Module 10 has a frame assembly consisting of relatively massive upper and lower frame members 12, 12', preferably formed of nonmagnetic stainless steel powdered metal, and a relatively thin frame plate 14 that preferably is formed from brass and by a stamping operation. Plate 14 is positioned between frame members 12, 12', spaces them from each other, and has at its forward end an upturned edge 16 that is received within a downwardly-opening groove 18 provided within the forward portion of upper frame member 12. The foregoing frame components are secured together by pin and screw-type fasteners 20, 22, 23 of which only illustrative ones are shown in FIG. 1.

Figure 5:
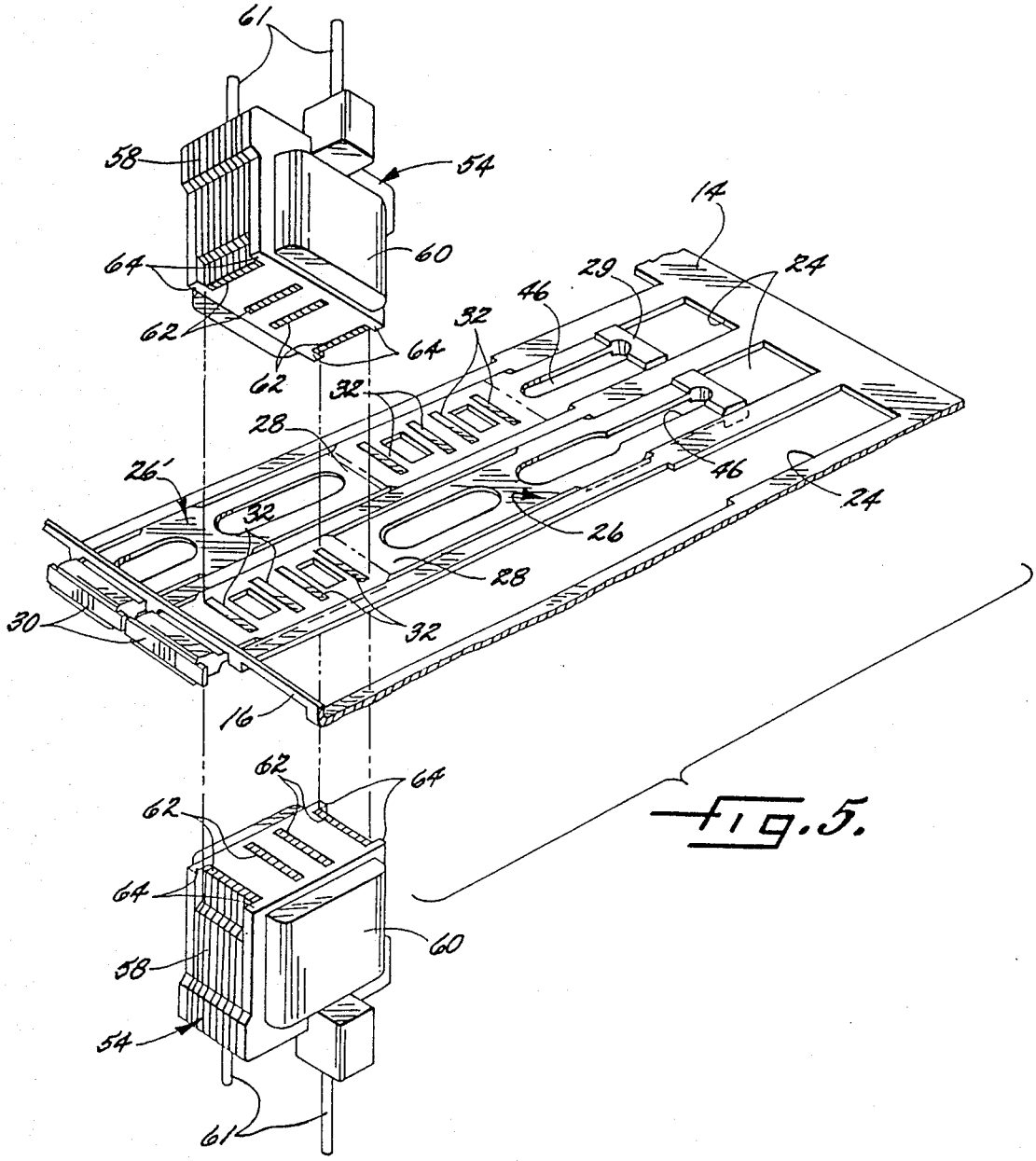
FIG. 5 is an enlarged front perspective view of slider and electromagnet components of the module, and of a fragmentary portion of a central frame plate of the module.

Frame plate 14 has a plurality (illustratively eight) of laterally spaced parallel slots 24 which extend forwardly from the rear edge of plate 14 and pass under its upturned forward edge 16. Slots 24 receive and constrain lateral movement of respective ones of a corresponding plurality of elongate ram or slider members 26, 26', of which only illustrative ones are shown. As is best shown in FIG. 5, each slider 26 has an elongate lightweight body 28 that preferably is formed of injection-molded plastic material and that has an impact surface 29 at its rear end. The slider body supports at its forward end a hammer face 30, preferably formed of stamped sheet metal, and has intermediate its length a plurality (illustratively four) of armature elements 32 preferably formed of chemically etched electrical steel coated with titanium nitride. Openings are also provided through slider body 28, for the purpose of further reducing its weight and/or of receiving fastener and other components of module 10. Sliders 26', which alternate with sliders 26 in a lateral direction, differ from them only in that their armature elements and certain of their openings are disposed at different locations along their length.

Spring-damper means in the form of units 34, only one of which is shown in FIG. 1, are associated with respective ones of the sliders 26, 26'. Each unit 34 has upper body portions 36, 38 that overlie the upper surface of upper frame member 12. Each unit 34 also has a downwardly depending body portion 40 and a downwardly depending U-shaped spring element 42 which extend through vertically aligned openings 44 of frame members 12, 12'. The spring element 42 of each unit 34 also extends through an elongate opening 46 within the associated one of the sliders 26 or 26', and the rearward leg of the spring element resiliently biases such slider to a rearward inactive position wherein the bumper surface 29 of the slider engages a multi-layered rubber damper pad 48 secured to the forward face of downwardly depending portion 40 of unit 34. The dimensions of each unit 34 are significantly less than those of the openings 44 through which it extends, in the longitudinal direction (i.e., parallel to the central axes of slider elements 26, 26' and the frame plate slots 24 within which such sliders are received). An opening 50 within the upper rearward portion 38 of each unit 34 similarly has a dimension in the longitudinal direction that is significantly greater than the diameter of a screw-type fastener 52 that extends through opening 50, an aligned opening of a gang washer 53 overlying body portion 38 of unit 34, and into a mating threaded bore 39 within upper frame member 12. The foregoing dimensional relationships permit longitudinal adjustment of the position of each spring-damper unit 34, and thus of the longitudinal inactive position of the slider 26 or 26' associated therewith. Following positional adjustment of units 34 they are secured in place by tightening fasteners 52.

Forward movement is imparted at desired times to selected ones of sliders 26, 26' by energization of electromagnetic actuator means respectively associated therewith. This preferably and illustratively consists of pairs of electromagnets 54 that are associated with respective ones of the sliders 26 or 26'. The electromagnets 54 of each pair are disposed in vertical alignment with each other upon opposite sides of the associated slider, and project through an aligned pair of the openings 56 extending through upper and lower frame members 12, 12'. The openings 56 of each frame member are preferably and illustratively staggered in a lateral direction so as to permit more components to be "packed" into a print mechanism of given size. Each electromagnet 54 includes a plurality of stamped laminations that are welded together to form a stator core 58, and a bobbin-wound coil 60 that is secured thereto by plastic encapsulation. Coil 60 is energized at desired times via electrical contacts 61 projecting from the outer end of each electromagnet. At its inner end, each electromagnet has four pole faces 62 which are adapted to be in substantial vertical alignment with the armature elements 32 of the associated slider 26 or 26' at those times when the magnetic flux generated by electromagnets 54, upon energization thereof, has advanced the slider forwardly from its inactive position to its active "print" position. In the inactive position of the slider, the rearward edges of the pole faces 62 of the associated electromagnets 54 are in approximate vertical alignment with the forward edges of the slider armature elements 32. As is best shown in FIG. 5, feet 64 are provided at the four corners of stator core 58. The feet engage those sections of brass frame plate 14 upon opposite sides of the frame plate opening or slot 24 within which the associated slider 26 or 26' is mounted. Such engagement ensures realization and maintenance of proper vertical spacing between the pole faces 62 of the electromagnets 54 of each vertically aligned pair. The electromagnet-receiving openings 56 within frame members 12, 12' therefore need not be and preferably are not so constructed as to maintain such spacing between electromagnets 54.

The relative dimensions of electromagnets 54 and of the frame openings 56 within which they are received are such as to permit longitudinal adjustive movement of the electromagnets relative to frame members 12, 12', and thus relative to the sliders 26 or 26' with which electromagnets 54 are associated. Since relative longitudinal adjustive movement between each electromagnet 54 and its associated slider 26 or 26' is realized by adjustive longitudinal movement of the electromagnet, the forward stroke of movement undergone by each slider can be optimized, from the viewpoint of flight time and impact force, without disturbing lateral alignment previously produced between the forward ends of the sliders by longitudinal adjustment of the positions of spring-damper assemblies 34.

Figure 3:
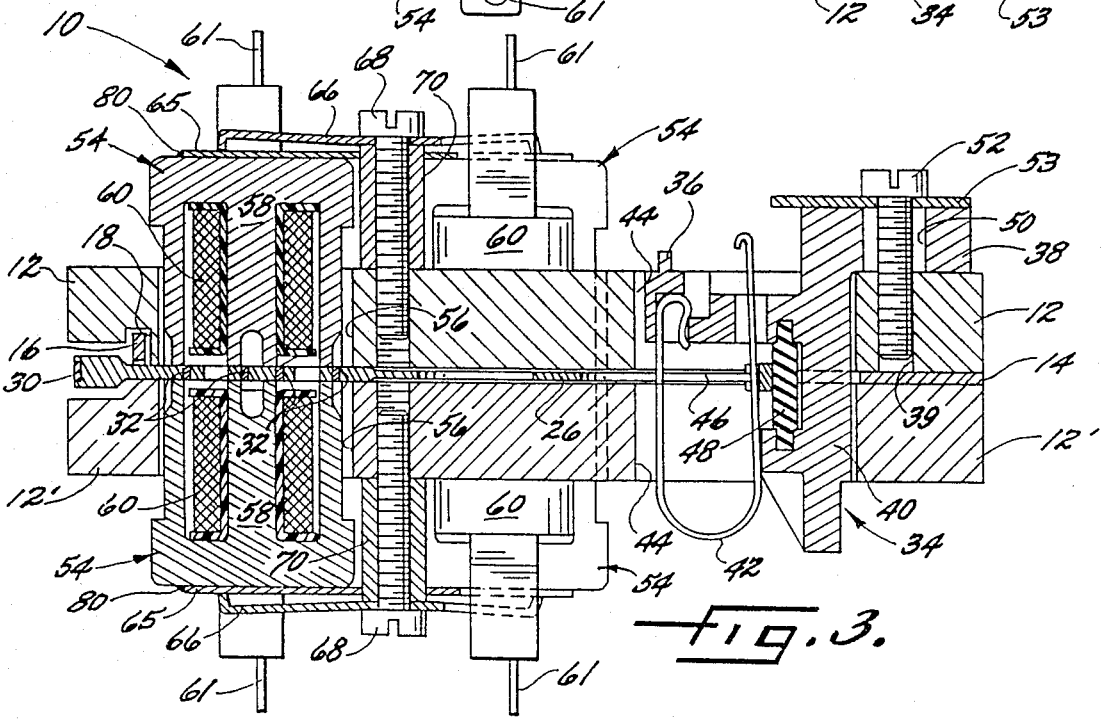
FIGS. 3 and 4 are vertical sections, with some components shown in side elevation, respectively taken substantially along the lines 3—3 and 4—4 through the module of FIG. 2.
Figure 4:
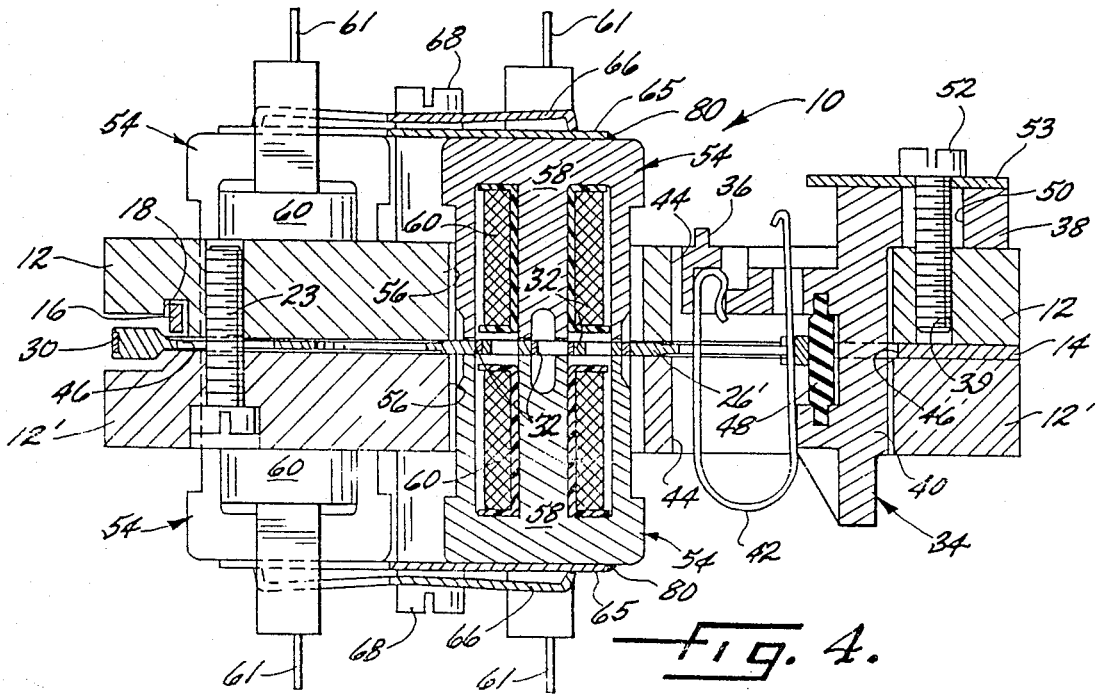

The outer faces of the electromagnets 54 associated with upper and lower frame members 12, 12' are engaged by projecting arms of respective upper and lower retainer plates 65. The outer surfaces of the upper and lower retainer plates are in turn engaged by projecting resilient arms of respective upper and lower gang clamps 66, respectively. Each gang clamp/retainer plate pair is secured to its associated frame member 12 or 12' by screw-type fasteners 68, only two of which are shown in FIG. 1. These extend through bores of the retainer plate and clamp, and through tubular spacer studs 70, and then into threaded bores of frame member 12 or 12'. When fasteners 68 are tightened to an appropriate extent, inwardly directed clamping forces are imposed upon electromagnets 54 by the resilient arms of gang clamps 66. The clamping forces maintain engagement of the feet 64 of each electromagnet 54 with frame plate 14. The magnitude of the clamping forces is sufficiently small as to permit longitudinal adjustive movement of electromagnets 54 when adjustive forces of appropriate direction and magnitude are applied to them, but are sufficiently large as to at other times temporarily maintain the electromagnets in whatever adjustive positions to which they are positively displaced. At different adjustive positions thereof, the two electromagnets associated with each slider are briefly energized and the characteristics of the resulting slider movement are monitored to determine which adjustive position of the electromagnets is optimal from the viewpoint of slider flight time and impact force. The electromagnets 54 of each pair preferably are then permanently secured in such adjustive position, as by laser welding them to those arms of the retainer plates 65 that engage their outer surfaces. The numeral 80 in FIG. 3 designates such welds.

As is apparent from the foregoing description, the method of manufacturing a print mechanism of the type in question preferably includes the steps of assembling the frame components 12, 12', 14 and the sliders 26, 26' with each other, mounting the electromagnets 54 and the spring-damper units 34 upon the frame means for independent adjustive longitudinal movement relative to the frame means and to each other, adjusting the longitudinal positions of spring-damper units 34 to effect substantial lateral alignment of the forward ends of sliders 26, 26', securing spring-damper units 34 in their adjustive positions, adjusting the longitudinal positions of electromagnets 54 to vary the characteristics of the forward strokes of movements imparted by them to sliders 26, 26', and fixedly securing electromagnets 54 to the frame means in those adjustive positions wherein optimal slider movement is realized. The step of mounting electromagnets 54 for adjustive movement preferably further includes subjecting them to clamping forces that permit their movement between different adjustive positions, but which are sufficient to temporarily maintain the electromagnets stationary when adjustive forces are not being applied to them. The method preferably further includes monitoring the movement characteristics imparted to each slider 26 or 26' by its associated electromagnets 54 in different adjustive positions of the electromagnets, for the purpose of identifying the adjustive position wherein optimal movement characteristics of the slider are realized.

Since the print mechanism of the present invention permits independent adjustment of the sliders' lateral alignment and of their forward strokes of movement, both adjustments may be precisely made and post-assembly grinding or other machining of the forward slider ends is not necessary. This contributes significantly to the ease and economy of manufacture of the print mechanism. Also significant in the foregoing regard is the utilization in the mechanism of an inexpensive stamped frame plate that performs the multiple functions of restricting lateral movement of the sliders, maintaining optimal spacing between the pole faces of confronting ones of the electromagnets, and providing a surface upon which adjustive movement of the electromagnets can readily occur.

While a preferred embodiment of the invention has been shown and described, this was for purposes of illustration only, and not for purposes of limitation, the scope of the invention being in accordance with the following claims.

We claim:

1. A print mechanism for a high speed printer of the linear actuator type, comprising:

a frame assembly including a pair of relatively massive superimposed frame members, and a relatively thin frame plate disposed between said frame members and spacing said members from each other, said plate having a plurality of elongate slot-like openings therein;

a plurality of elongate sliders mounted within said openings of said plate of said frame assembly in laterally spaced adjacent relationship to each other for longitudinal movement in forward and rearward directions, said plate constraining lateral movement of said sliders;

a plurality of spring-containing units mounted by said frame assembly for independent longitudinal adjustive movement relative to each other and to said frame assembly, each of said units biasing an associated one of said sliders toward a rearward inactive position and said adjustive movement thereof varying said inactive position of said associated slider relative to said frame assembly and other of said sliders;

a plurality of electromagnets mounted by said frame assembly in association with respective ones of said sliders for adjustive longitudinal movement relative to said sliders and to said frame assembly, energization of said electromagnets imparting forward movement to the therewith associated one of said sliders and said longitudinal adjustive movement of said electromagnets being effective to vary characteristics of said forward slider movement;

said spring-containing units and said electromagnets being adjustable independently of each other to permit independent adjustment of the relative inactive positions of said sliders and of the characteristics of said forward slider movement.

2. A print mechanism as in claim 1, and further including clamping means for subjecting said electromagnets to clamping forces permitting intentional adjustive movement while resisting other movement thereof.

3. A print mechanism as in claim 2, and further including means for fixedly securing said spring-containing units and said electromagnets in desired adjustive positions thereof.

4. A print mechanism as in claim 1, wherein said electromagnets have surface portions abutting said frame plate and slidably movable therealong during said adjustive movement of said electromagnets.

5. A print mechanism as in claim 1, wherein a pair of confronting ones of said electromagnets are associated with each of said sliders, said confronting electromagnets being disposed in spaced relationship to each other upon opposite sides of said slider and said frame plate, and the spacing between said electromagnets being regulated by said frame plate.

6. A print mechanism as in claim 5, wherein said frame members have openings therein receiving said electromagnets, the relative longitudinal dimensions of said openings and of said electromagnets being such as to permit said longitudinal adjustive movement of said electromagnets within said openings.

7. A print mechanism as in claim 6, wherein each of said units includes a damper pad and each of said sliders has a bumper surface engageable with said damper pad of the associated one of said units when said slider occupies said inactive position thereof.

8. A print mechanism for a high speed printer of the linear actuator type, comprising:

a frame assembly including a pair of relatively massive superimposed frame members, and a relatively thin frame plate disposed between said frame members and spacing said members from each other;

a plurality of elongate sliders mounted by said frame assembly in laterally spaced adjacent relationship to each other for longitudinal movement in forward and rearward directions;

a plurality of spring-containing units mounted by said frame assembly for independent longitudinal adjustive movement relative to each other and to said frame assembly, each of said units biasing an associated one of said sliders toward a rearward inactive position and said adjustive movement thereof varying said inactive position of said associated slider relative to said frame assembly and other of said sliders;

a plurality of electromagnets mounted by said frame assembly in association with respective ones of said sliders for adjustive longitudinal movement relative to said sliders and to same frame assembly, energization of said electromagnets imparting forward movement to the therewith associated one of said sliders and said longitudinal adjustive movement of said electromagnets being effective to vary characteristics of said forward slider movement, said electromagnets having surface portions abutting said frame plate and slidably movable therealong during said adjustive movement of said electromagnets;

said spring-containing units and said electromagnets being adjustable independently of each other to permit independent adjustment of the relative inactive positions of said sliders and of the characteristics of said forward slider movement.

9. A print mechanism as in claim 8, wherein said plate has a plurality of elongate slot-like openings receiving said sliders and constraining lateral movement thereof while permitting said longitudinal slider movement.

10. A method of manufacturing a printing mechanism for a high speed impact printer of the linear actuator type, the mechanism including a frame assembly having a frame plate containing slot-like openings mounting a plurality of sliders in laterally spaced adjacent relationship for longitudinal forward and rearward movement, a plurality of spring-containing units associated with respective ones of the sliders for biasing the sliders rearwardly toward inactive positions, and a plurality of electromagnets associated with the sliders for when energized imparting forward movement to the sliders, which method comprises:

mounting the spring-containing units and the electromagnets upon the frame assembly for independent longitudinal adjustive movement relative to the frame assembly;

establishing engagement of end portions of the electromagnets with the frame plate;

adjusting the longitudinal positions of the spring-containing units to adjust the relative longitudinal inactive positions of the sliders; and adjusting the longitudinal positions of the electromagnets to adjust characteristics of the forward movement imparted to the sliders by the electromagnets.

11. A method as in claim 10, and further including fixedly securing the spring-containing units in place following positional adjustment thereof and prior to effecting positional adjustment of the electromagnets.

12. A method as in claim 10, wherein the step of mounting the electromagnets includes subjecting the electromagnets to clamping forces permitting intentional adjustive movement and resisting other movement thereof.

13. A method as in claim 12, and further including fixedly securing the spring-containing units and the electromagnets in place following positional adjustment thereof.

14. A method as in claim 13, including monitoring characteristics of the forward movement imparted to the sliders by the associated electromagnets in different adjustive positions of the magnets.

15. A method as in claim 14, including establishing substantial lateral alignment between the forward ends of the sliders while making the adjustment of the relative longitudinal inactive positions of the sliders.

16. A method as in claim 10, wherein the step of establishing engagement of end portions of the electromagnets with the frame plate includes biasing the electromagnets toward the frame plate.

* * * * *